United States Patent [19]

Satoh

[11] Patent Number: 4,691,145

[45] Date of Patent: Sep. 1, 1987

[54] DRIVE CIRCUIT FOR FLUORESCENT DISPLAY TUBE

[75] Inventor: Taizo Satoh, Kawasaki, Japan

[73] Assignee: Fujitsu Limited, Kanagawa, Japan

[21] Appl. No.: 942,048

[22] Filed: Dec. 16, 1986

Related U.S. Application Data

[63] Continuation of Ser. No. 624,548, Jun. 26, 1984, abandoned.

[30] Foreign Application Priority Data

Jun. 29, 1983 [JP] Japan ..... 58-115879

[51] Int. Cl.[4] ..... G09G 3/10

[52] U.S. Cl. ..... 315/169.3; 340/776; 340/813; 315/169.1; 315/169.4; 315/260

[58] Field of Search ..... 315/169.1, 169.2, 169.3, 315/169.4, 167, 168, 107, 260, 311; 340/813, 776, 777; 307/242, 568, 141, 141.8; 357/46

[56] References Cited

U.S. PATENT DOCUMENTS 4,068,148 1/1978 Nomiya et al. ..... 340/813 X
4,109,180 8/1978 Ogle et al. ..... 340/813 X
4,286,174 8/1981 Dingwall ..... 307/242
4,384,287 5/1983 Sakuma ..... 315/169.4
4,472,660 9/1984 Knothe et al. ..... 315/169.4
4,523,217 6/1985 Jibu ..... 357/46 X

FOREIGN PATENT DOCUMENTS 2831745 1/1980 Fed. Rep. of Germany ..... 340/813

*Primary Examiner*—Saxfield Chatmon
*Attorney, Agent, or Firm*—Armstrong, Nikaido, Marmelstein & Kubovcik

[57] ABSTRACT

A drive circuit for a fluorescent display tube used for displaying numerals, characters, and so on, which circuit includes a plurality of drivers for switching the potential of segments and/or grids of the fluorescent display tube. Part or all of the drivers each has a plurality of transistor elements whose drive timings differ from each other, thereby decreasing the transition speed of the output signals of the drivers and preventing the drivers from being destroyed by excessive voltage caused by the switching operation thereof.

12 Claims, 11 Drawing Figures

DRIVE CIRCUIT FOR FLUORESCENT DISPLAY TUBE

This application is a continuation of application Ser. No. 624,548 filed June 26, 1984, abandoned.

BACKGROUND OF THE INVENTION

1. Field of the Invention

The present invention relates to a drive circuit for a fluorescent display tube, more particularly to a drive circuit in which each of the high withstand-voltage output transistors for turning on and off the voltages of the grids and/or segments of a fluorescent display tube is divided into a plurality of transistor elements, thereby preventing the output transistors from being destroyed by excessive voltage.

2. Description of the Prior Art

In a fluorescent display tube used for displaying numerals, characters, and the like, a high withstand-voltage output transistor is provided for and connected to one or more segments and grids. A required numeral, character, or the like is displayed by selectively controlling the voltage of each segment or grid using these transistors.

These high withstand-voltage transistors output, for example, voltages of +5 V to −25 V. When the voltage of a segment or grid is changed, from +5 V to −25 V, an excessive voltage of, for example, near −50 V is applied to the drive transistor for the grid or segment due to the capacitance between the segment and the grid. This excessive voltage can destroy the drive transistor.

In order to prevent the destruction of a drive transistor due to excessive voltage, conventional circuits have been provided with a diode connected between the output terminal of each drive transistor and the power source. The conventional circuits, however, are unsuitable when fluorescent display tubes are driven and controlled by, for example, a one-chip microcomputer or by other circuits. The diodes necessitate a relatively large space in the peripheral circuit, decreasing the packing density of the system and complicating the manufacturing process, thereby increasing costs.

SUMMARY OF THE INVENTION

In order to solve the above-mentioned problems of conventional circuits, the present invention adopts an idea of using in a drive circuit for fluorescent display tubes, composite transistors each having a plurality of transistor elements as drive transistors for grids and/or segments and of differentiating the drive timings of the plurality of transistor elements of each composite transistor.

It is an object of the present invention to prevent the application of excessive voltage to each drive transistor without using diodes, thereby preventing the destruction of the transistor, decreasing the area of a circuit, simplifying the manufacturing process, and reducing costs.

This object is attained by providing a drive circuit for a fluorescent display tube, the drive circuit comprising a plurality of drivers for controlling potentials of one or more selected segments or grids of the fluorescent display tube to effect a display operation, part or all of the drivers having a plurality of transistor elements, the drive timings of the plurality of transistor elements differing from each other, thereby decreasing the transition speed of the output signals of the drivers.

BRIEF DESCRIPTION OF THE DRAWINGS

Other objects and features of the present invention will become apparent from the following description of the preferred embodiments made in reference to the accompanying drawings, in which.

DESCRIPTION OF THE PREFERRED EMBODIMENTS

Figure 1:
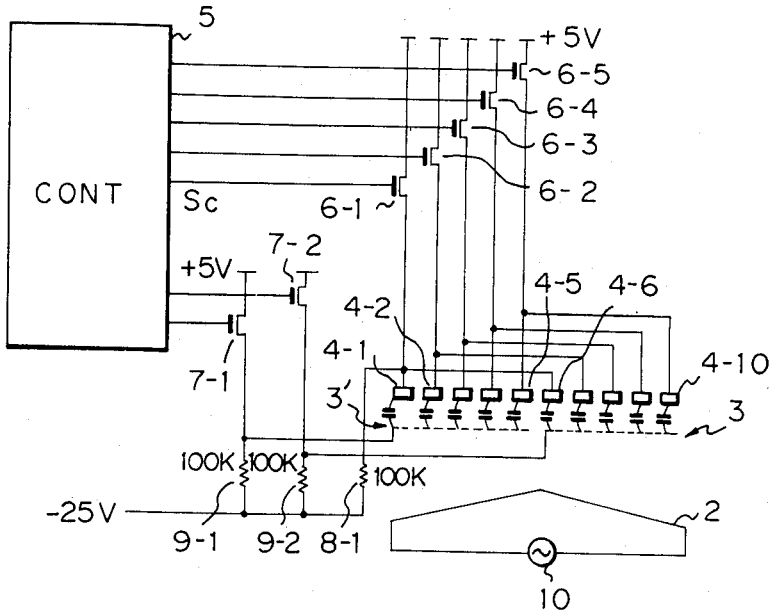
FIG. 1 is a block circuit diagram of a structure of a general fluorescent display tube and a drive circuit.

FIG. 1 schematically illustrates a general fluorescent display tube and a drive circuit therefor. As illustrated in FIG. 1, a fluorescent display tube 1 includes a filament, i.e., cathode 2, grids 3 and 3′, and segments 4-1, 4-2, ---, 4-5, 4-6, ---, 4-10, all arranged in a vacuum container (not shown). The drive circuit for the fluorescent display tube includes a control circuit 5, output transistors 6-1, 6-2, ---, 6-5, such as P-channel metal-oxide semiconductor (MOS) transistors, used for driving the segments, and output transistors 7-1 and 7-2, such as P-channel MOS transistors, used for driving the grids.

The output transistor 6-1 for driving the segments controls the voltage applied to two segments 4-1 and 4-6. The drain of the output transistor 6-1 is connected to the segments 4-1 and 4-6 and connected to a power source of −25 V through a resistor 8-1, whose resistance is, for example, 100 kiloohm. The source of the output transistor 6-1 is connected to a power source of +5 V.

The other transistors 6-2, 6-3, 6-4, and 6-5 for driving the segments are similarly connected to drive two segments 4-2 and 4-7, 4-3, and 4-8, 4-4 and 4-9, and 4-5 and 4-10, respectively. In FIG. 1, illustration of the 100 kiloohm resistors connected between the drains of these transistors 6-2, 6-3, 6-3 and the power source of −25 V is omitted for the sake of simplicity.

The drains of the transistors 7-1 and 7-2 for driving the grids are connected to the power source of −25 V through resistors 9-1 and 9-2, respectively, each having a resistance of, for example, 100 kiloohm, and are connected to the grids 3′ and 3, respectively. The grid 3′ is a mesh electrode disposed between the cathode 2 and the segments 4-1, 4-2, ---, 4-5, and the grid 3 is a mesh electrode disposed between the cathode 2 and the segments 4-6, 4-7, ---, 4-10.

In the circuit of FIG. 1, a character, numeral, and so on is displayed by selectively applying voltage to the grids 3 and 3' and to the segments 4-1, 4-2, ---, 4-10 while the cathode 2 is heated up by a power source 10 so as to illuminate the liminous body painted on the selected segment or segments. For example, when the segment 4-1 is to be illuminated, the transistor 7-1 is turned on by applying a low-level voltage to the gate of the transistor 7-1 from a control circuit 5 and a high voltage of approximately +5 V to the grid 3'. Moreover, the transistor 6-1 is turned on by applying a low-level voltage to the gate of the transistor 6-1 from the control circuit 5 and a high voltage of approximately +5 V to the segment 4-1. Thereby, electrons emitted from the cathode 2 reach the segment 4-1 through the grid 3' and illuminate the luminous body painted on the segment 4-1.

In this case, although the high voltage is also applied to the segment 4-6, the electrons emitted from the cathode 2 do not reach the segment 4-6, because the low voltage of −25 V is applied to the grid 3 corresponding to the segment 4-6 through the resistor 9-2, so that the segment 4-6 does not illuminate. In this way, in order to illuminate a segment, it is necessary to apply the high voltage to the segment and to the grid corresponding to the segment. Such application of high voltage is attained by selectively turning on each output transistor by using a control signal output from the control circuit 5.

Assume that the voltage of −25 V is applied to a grid and the voltage of +5 V is applied to the segment corresponding to the grid. In this condition, if the voltage applied to the segment changes from +5 V to −25 V, i.e., if the output transistor connected to the segment changes from the on condition to the off condition, the voltage of the grid falls to a further lower voltage of, for example, approximately −50 V from −25 V due to the capacitance between the segment and the grid, placing the transistor for driving the grid in danger of destruction.

Figure 2:
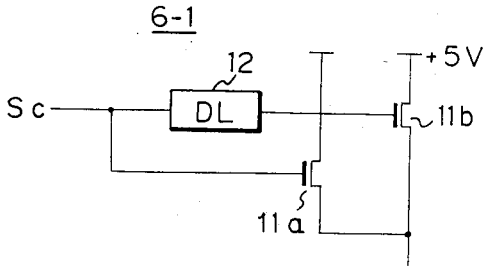
FIG. 2 is a block circuit diagram of a structure of a drive transistor used in a drive circuit as an embodiment of the present invention.
Figure 3:
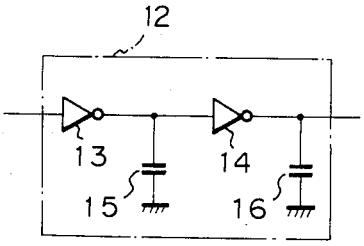
FIG. 3 is a block circuit diagram of a structure of a delay circuit used in the circuit of FIG. 2.

To avoid such destruction, in the drive circuit according to the present invention, each output transistor for driving the segment has a plurality of transistor elements. The drive timings of the transistor elements differ from each other so that the voltage of the segment does not change rapidly. That is, as shown in FIG. 2, an output transistor for driving a segment, for example, 6-1, is divided into two transistor elements 11*a* and 11*b*. The control signal Sc from the control circuit is applied directly to the gate of the transistor element 11*a* and via a delay circuit 12 to the gate of the transistor element 11*b*. The size of the transistor element 11*a* is larger than that of the transistor element 11*b*, so that the transistor element 11*a* can pass a large current. Therefore, for example, the on-resistance of the transistor element 11*a* is several hundred ohms, the off-resistance thereof several megohms, the on-resistance of the transistor element 11*b* is a 100 kiloohms, and the off-resistance thereof several megohms. The delay circuit 12 comprises, for example, as shown in FIG. 3, two buffer amplifiers or inverters 13 and 14 and capacitors 15 and 16 connected to the inverters.

Figure 4A:
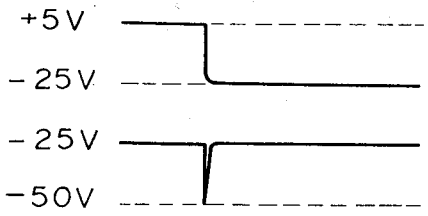
FIGS. 4A and 4B are waveform diagrams of the operation of a conventional drive circuit.
Figure 4B:
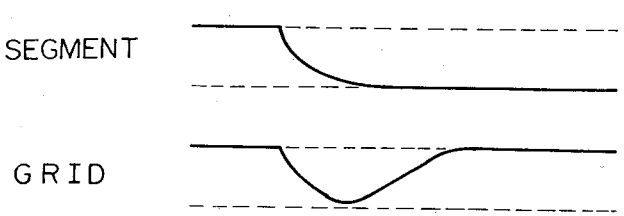

In the structure of FIG. 2, since the transistor elements 11*a* and 11*b* are turned on and off at mutually different timings, a rapid change in the segment voltage can be avoided and the amplitude of the excessive voltage generated at the grid becomes small. That is, as shown in FIG. 4A, in the conventional circuit, when the segment voltage changes from +5 V to −25 V, an excessive voltage reaching from −25 V to approximately −50 V is generated at the corresponding grid. FIG. 4B shows, voltage waveforms enlarged from those of FIG. 4A in the direction of the time axis.

Figure 5A:
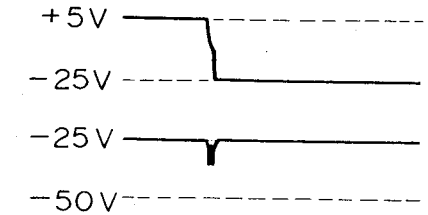
FIGS. 5A and 5B are waveform diagrams of the operation of a drive circuit as an embodiment of the present invention.
Figure 5B:
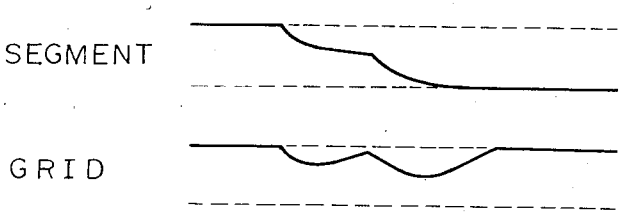

On the other hand, in the circuit shown in FIG. 2, after the control signal Sc changes from a low potential level to a high potential level, only one transistor element 11*a* changes from the on condition to the off condition. At this time, if the on-resistance of the other transistor element 11*b* is, for example, 100 kiloohms, the segment voltage falls to −10 V. Then, after the time period determined by the delay circuit 12, the other transistor element 11*b* changes from the on condition to the off condition and the segment voltage reaches −25 V. In this way, since the segment voltage is changed in two steps, the change of the segment voltage becomes slow as shown in FIGS. 5A and 5B, and the excessive voltage generated in the corresponding grid does not fall under approximately −40 V. Thereby, destruction of the output transistor for driving a grid can be avoided.

In FIG. 2, each output transistor is divided into two elements. The number of elements of each output transistor is not limited to two and clearly can be any plural value. It is also clearly possible to constitute a composite transistor by series connection or series and parallel connection of the divided transistor elements in addition to simple parallel connection.

Figure 6:
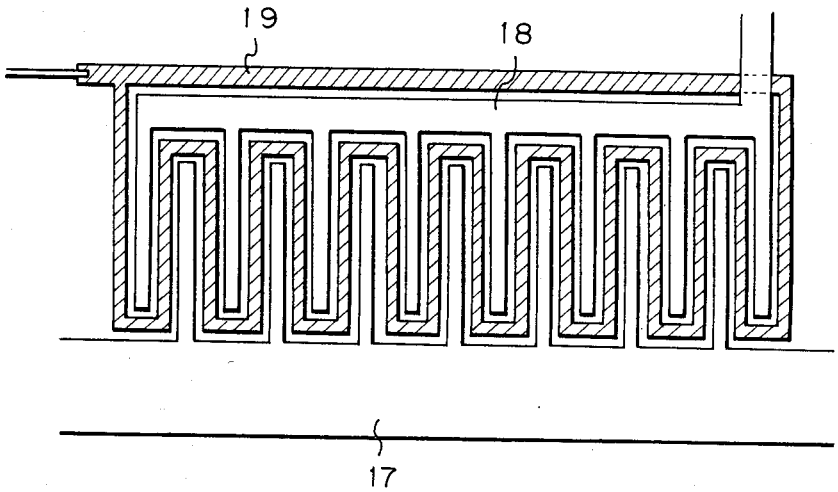
FIG. 6 is a plan view of a structure of a drive transistor used in a conventional drive circuit.

FIG. 6 illustrates a schematic structure of a conventional output transistor. The transistor of FIG. 6 includes a source electrode 17 and a drain electrode 18 connected to, for example P+-type diffusion layers formed on an N−-type semiconductor substrate. A gate electrode 19 is formed on a region between the source electrode 17 and the drain electrode 18 via an insulation layer (not shown).

Figure 7A:
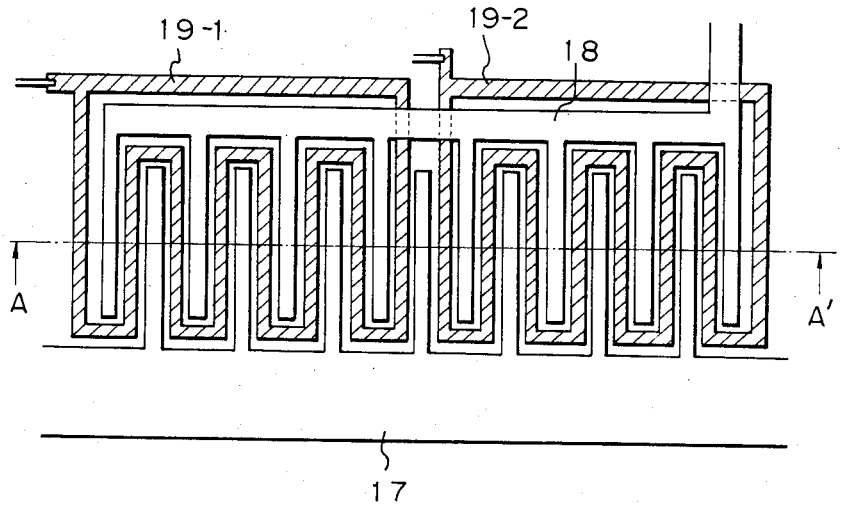
FIG. 7A is a plan view of a structure of a drive transistor used in a drive circuit as an embodiment of the present invention.

FIG. 7A illustrates a structure of a high withstand-voltage transistor used as an output transistor for driving a segment in a drive circuit of an embodiment of the present invention. The transistor of FIG. 7B includes a source electrode 17 and a drain electrode 18 connected to, for example, P+-type diffusion layers formed on an N−-type semiconductor substrate. These source electrode 17 and drain electrode 18 are formed in the same sizes and shapes as those of the transistor of FIG. 6. In the transistor shown in FIG. 7A, gate electrodes are divided into two portions and formed on the region between these source electrodes 17 and drain electrodes 18 via an insulation layer, as the gate electrodes 19-1 and 19-2. To these gate electrodes 19-1 and 19-2 are applied the control signals having different timings.

Figure 7B:
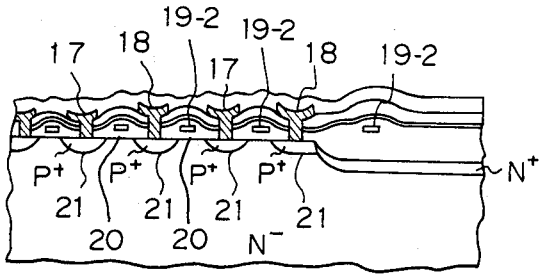
FIG. 7B is a partial sectional view taken on line A—A′ of FIG. 7A.

FIG. 7B is a sectional view of the transistor shown in FIG. 7A taken on line A-A'. As shown in FIG. 7B, the source electrode 17 and the drain electrode 18 are connected to the respective P+-type regions 21, and the gate electrode 19-2 is formed on the region between the source electrode 17 and the drain electrode 18 via the insulation layer 20.

Figure 8:
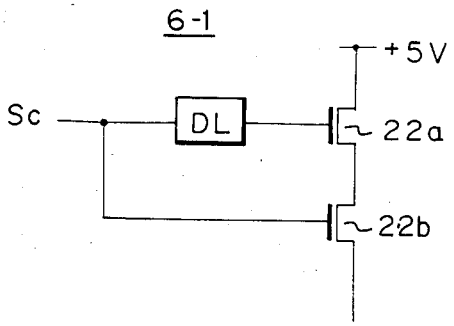
FIG. 8 is a block circuit diagram a drive transistor used in a drive circuit as another embodiment of the present invention.

FIG. 8 illustrate another example of a structure of a drive transistor. In the transistor of FIG. 8, transistor elements 22*a* and 22*b* are series connected, a control signal Sc is applied to the gate of the transistor 22*a* via a delay circuit 12, and the control signal Sc is directly applied to the gate of the transistor element 22*b*. In the transistor of FIG. 8, for example, the on-resistance of the transistor element 22*a* is several hundred ohms, the off-resistance thereof is several megohms, the on-resistance of the transistor element 22*b* is several hundred ohms, and the off-resistance thereof is 100 kiloohms. By using this structure, it is possible to attain advantageous effects similar to those of the transistor of FIG. 2.

As mentioned above, according to the present invention, it is possible to avoid the destruction of output transistors for driving a fluorescent display tube without using diodes and the like. Therefore, it becomes possible to reduce the area occupied by a drive circuit and to improve the reliability thereof. Since the drive circuit does not require protective diodes, the manufacturing process can be simplified and the manufacturing costs can be reduced.

I claim:

1. A driver circuit for a fluorescent display tube, said driver circuit comprising:

a plurality of first drivers, each for selectively controlling a potential of a corresponding segment of said fluorescent display tube; and a plurality of second drivers, each for selectively controlling a potential of a corresponding grid of said fluorescent display tube to effect a display operation, each of said first drivers having a plurality of transistor elements and a delay circuit, said plurality of transistor elements being connected in parallel, a control signal for driving said transistor elements being suppled to one of said transistor elements via said delay circuit, the drive timings of said plurality of transistor elements differing from each other, thereby decreasing the transition speed of the output signals of said first drivers.

2. The driver circuit of claim 1, wherein each of said first drivers comprises two transistor elements and a delay circuit, a control signal for driving said two transistor elements being supplied to one of said transistor elements via said delay circuit, and wherein said delay circuit includes one or more buffer amplifiers connected in cascade and one or more capacitors each loaded on the output of one of said buffer amplifiers.

3. The driver circuit of claim 1, wherein said plurality of transistor elements of said first drivers comprises a common source region and drain region formed on the same semiconductor substrate and a plurality of gate electrodes formed on a region between said common source region and drain region via an insulation layer.

4. A driver circuit for a fluorescent display tube, said driver circuit comprising:

a plurality of first drivers, each for selectively controlling a potential of a corresponding segment of said fluorescent display tube; and a plurality of second drivers, each for selectively controlling a potential of a corresponding grid of said fluorescent display tube to effect a display operation, each of said first drivers having a plurality of transistor elements and a delay circuit, said plurality of transistor elements being connected in series, a control signal for driving said transistor elements being supplied to one of said transistor elements via said delay circuit, the drive timings of said plurality of transistor elements differing from each other, thereby decreasing the transition speed of the output signals of said first drivers.

5. The driver circuit of claim 4, wherein each of said first drivers comprise two transistor elements and a delay circuit, a control signal for driving said two transistor elements being supplied to one of said transistor elements via said delay circuit, and wherein said delay circuit includes one or more buffer amplifiers connected in cascade and one or more capacitors each loaded on the output of one of said buffer amplifiers.

6. The driver circuit of claim 4, wherein said plurality of transistor elements of said first drivers comprises a common source region and drain region formed on the same semiconductor substrate and a plurality of gate electrodes formed on a region between said common source region and drain region via an insulation layer.

7. A driver circuit for a fluorescent display tube, said driver circuit comprising:

a plurality of first drivers, each for selectively controlling a potential of a corresponding segment of said fluorescent display tube; and a plurality of second drivers, each for selectively controlling a potential of a corresponding grid of said fluorescent display tube to effect a display operation, each of said second drivers having a plurality of transistor elements and a delay circuit, said plurality of transistor elements being connected in parallel, a control signal for driving said transistor elements being supplied to one of said transistor elements via said delay circuit, the drive timings of said plurality of transistor elements differing from each other, thereby decreasing the transition speed of the output signals of said second drivers.

8. The driver circuit of claim 7, wherein said delay circuit comprises one or more buffer amplifiers connected in cascade and one or more capacitors, each loaded on the output of said buffer amplifier.

9. The drive circuit according to claim 7, wherein said plurality of transistor elements of said second drivers comprises a common source region and drain region formed on the same semiconductor substrate and a plurality of gate electrodes formed on a region between said common source region and drain region via an insulation layer.

10. A driver circuit for a fluorescent display tube, said driver circuit comprising:

a plurality of first drivers, each for selectively controlling a potential of a corresponding segment of said fluorescent display tube; and a plurality of second drivers, each for selectively controlling a potential of a corresponding grid of said fluorescent display tube to effect a display operation, each of said second drivers having a plurality of transistor elements and a delay circuit, said plurality of transistor elements being connected in series, a control signal for driving said transistor elements being supplied to one of said transistor elements via said delay circuit, the drive timings of said plurality of transistor elements differing from each other, thereby decreasing the transition speed of the output signals of said second drivers.

11. The drive circuit of claim 10, wherein said delay circuit comprises one or more buffer amplifiers connected in cascade and one or more capacitors, each loaded on the output of said buffer amplifier.

12. The drive circuit according to claim 7, wherein said plurality of transistor elements of said second drivers comprises a common source region and drain region formed on the same semiconductor substrate and a plurality of gate electrodes formed on a region between said common source region and drain region via an insulation layer.

* * * * *